US005100306A

United States Patent [19]

Moran, Jr. et al.

[11] Patent Number: 5,100,306

[45] Date of Patent: Mar. 31, 1992

[54] NOISE REDUCING COMPRESSOR GASKET AND HEAD ASSEMBLY

[75] Inventors: John G. Moran, Jr., Livonia; Robert J. Hutter, Plymouth; James D. Gill, Dearborn, all of Mich.

[73] Assignee: Ford Motor Company, Dearborn, Mich.

[21] Appl. No.: 495,003

[22] Filed: Mar. 16, 1990

[51] Int. Cl.[5] ..... F04B 39/10

[52] U.S. Cl. ..... 417/571; 417/269; 417/569; 137/514

[58] Field of Search ..... 417/269, 271, 569, 571, 417/563; 137/514, 512.15

[56] References Cited

U.S. PATENT DOCUMENTS 4,668,172 5/1987 Shibuya et al. ..... 137/512.15

*Primary Examiner*—Richard A. Bertsch
*Assistant Examiner*—Charles Freay
*Attorney, Agent, or Firm*—Charles H. Ellerbrock; Roger L. May

[57] ABSTRACT

An air conditioning compressor comprises a compressor housing including front and rear housing heads and a pair of cylinder blocks disposed in the housing each defining axially disposed cylinders. The compressor also includes a double-acting piston in each cylinder opening, a swashplate and drive shaft assembly having a swashplate driveably engageable with each piston and a driveshaft mounted in each cylinder block coaxially therewith. The compressor further includes a valve assembly located between each housing head and each respective cylinder block. Each valve assembly includes an intake valve means disposed adjacent to the respective cylinder block, the intake valve means includes valve reeds that control flow from the low pressure passages to the cylinders, a valve plate disposed adjacent to the intake valve means, a discharge valve means disposed adjacent the valve plate, and a noise reducing gasket means disposed between the discharge valve means and the housing head. The noise reducing gasket means includes a first region disposed at a radially inward part of the gasket means for sealingly limiting gas transfer radially inwardly from the high pressure region, a second region radially outwardly spaced from the first region for sealingly limiting gas transfer from the high pressure region to the low pressure region, and a plurality of resilient members mounted in a cantilever fashion to the second region and having a free end spaced from the first region.

4 Claims, 7 Drawing Sheets

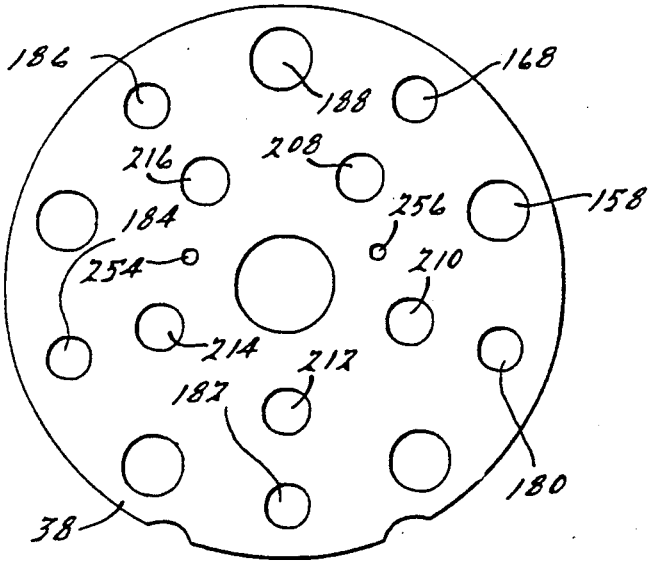
FIG. 7.
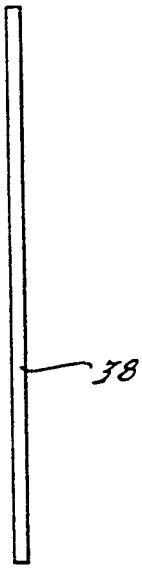
FIG. 8.
FIG. 9.
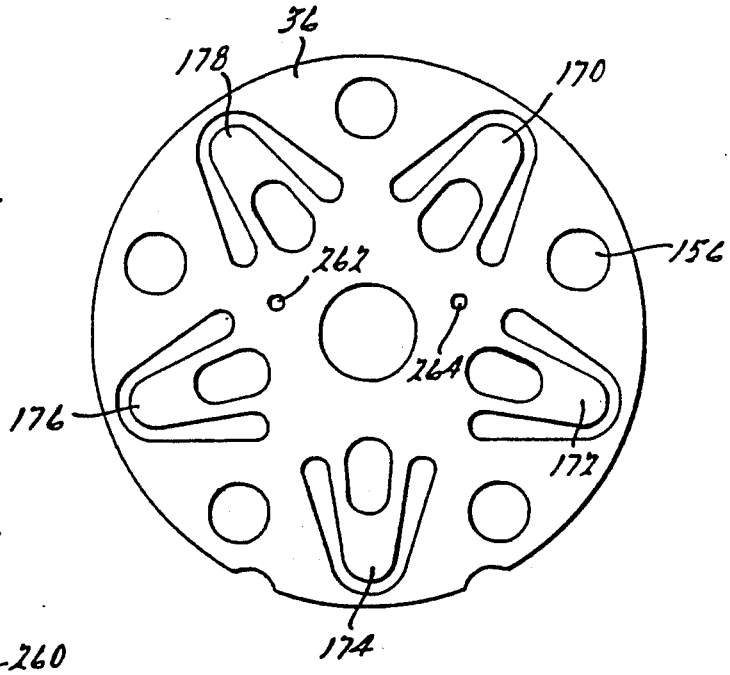
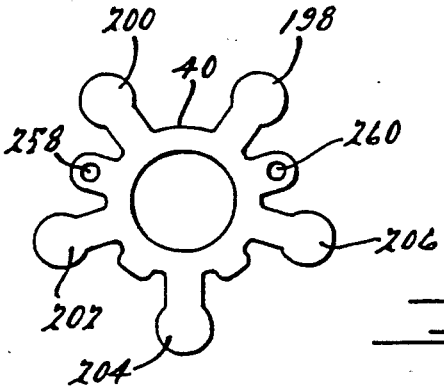
FIG. 10.

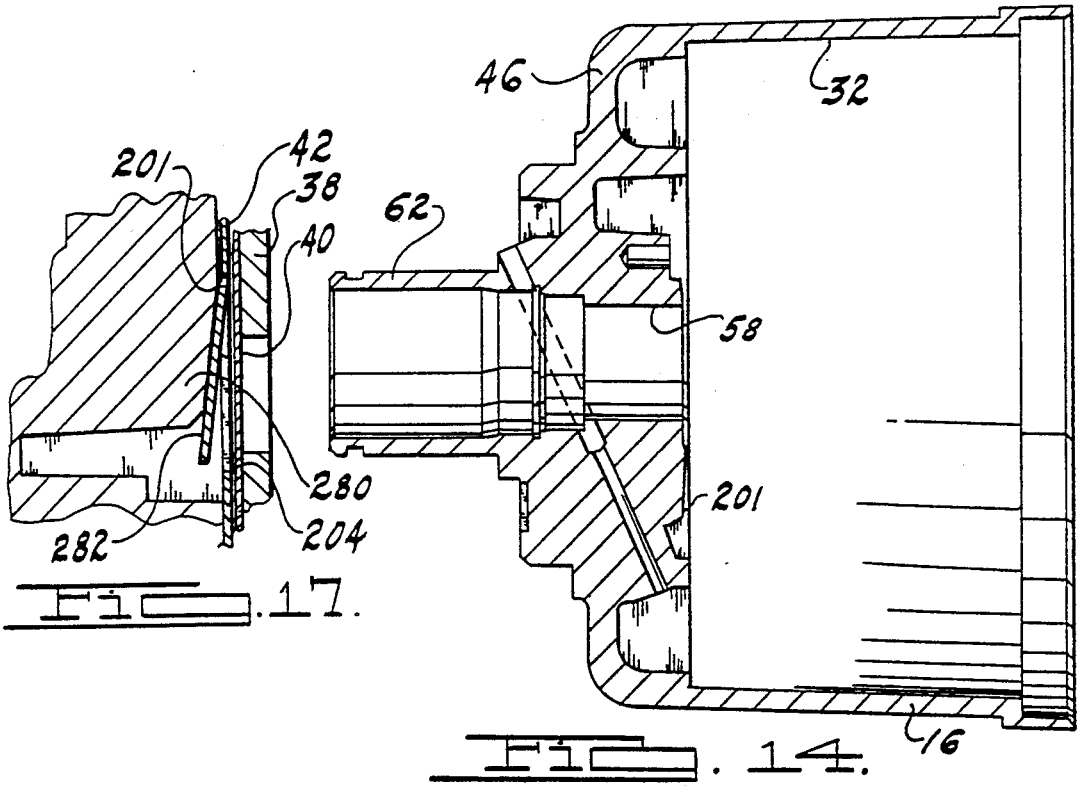
FIG. 17.
FIG. 14.
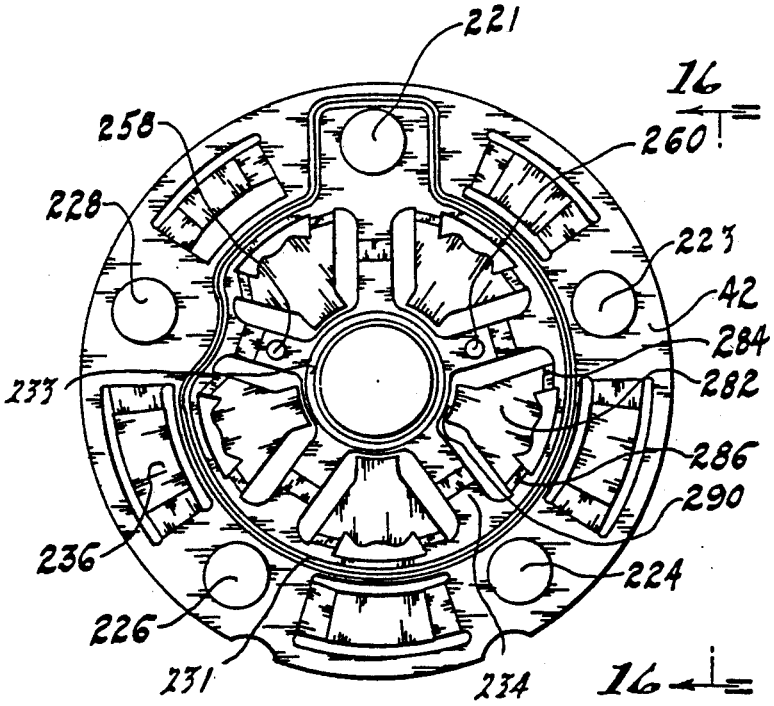
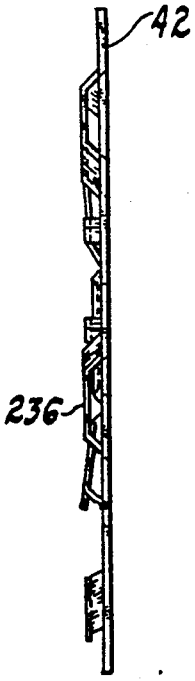
FIG. 15.
FIG. 16.

NOISE REDUCING COMPRESSOR GASKET AND HEAD ASSEMBLY

BACKGROUND OF THE INVENTION

1. Field of the Invention

The present invention is directed to an arrangement including a compressor gasket and head for use in an automotive air conditioning compressor.

2. Discussion of the Related Art

Air conditioning compressors may comprise a cast cylinder housing in which are formed axial cylinders that receive multiple axially movable pistons operated by a swashplate. The swashplate in turn is belt driven by the vehicle engine.

Such swashplate compressors normally comprise end plates located on either axial end of the cylinders, which are formed in the housing arranged in multiple parts. The housing parts and the end plates are bolted together in an end-to-end relationship. The end plates form valve cavities and valve elements control flow of refrigerant fluid or gas to each of the cylinders as the pistons for the respective cylinders are stroked during an intake stroke portion of the refrigeration cycle. Other valve elements are used to control the flow of fluid or gas from the end of each of the cylinders during the compressor stroke of each piston for the respective cylinders.

The manufacture and assembly of end plates and valve structure present complex machining and assembly problems, and the space occupied by the end plates and the associated valve parts creates packaging problems for air conditioning compressors in vehicle engine compartments.

U.S. Pat. No. 4,820,133 discloses a compressor design which provides a built-in cylinder housing head that forms an integral part of the compressor housing and provides inlet flow passages and high pressure discharge passages for the refrigerant that are cast in the housing head. The cylinder bodies are separate from and are enclosed within the housings and are arranged in juxtaposed relationship with respect to the ends of the housing heads in which the cast passages are formed. There is also a subassembly of intake and exhaust valve elements adjacent to each housing head. This subassembly includes a valve plate adjacent to the end of the cylinder block, a discharge valve disc defining reed valves that establish a controlled flow exit path for the high pressure fluid from the cylinders and an intake valve disc having reed valves that establish a controlled flow intake of refrigerant fluid to the cylinders. The valve plate and valve discs are purported to provide axial flow of fluid, both high pressure fluid and low pressure fluid, from one end of the cylinders to the other without the necessity for using external passage structure. These ports communicate with the axial passages formed in the cylinder blocks themselves.

The U.S. Pat. No. 133 discloses that the housing head includes a backup or stop for limiting the deflection of the discharge reed valves. There is also disclosed a sealed gasket or disc which is located between the discharge valve disc and the housing head which seals the high pressure regions of the compressor from the low pressure regions and also secures the discharge valve disc firmly against the valve plate at a radially inward location so that the base or radially inward locations of the discharge reed valves are not unduly stressed during operation.

However, it has been found that having the discharge reed valve directly contact the backup or stop of the housing head creates undesirable noise characteristics from the compressor. Thus, it is desirable to produce a compressor where this noise is reduced.

SUMMARY OF THE INVENTION

It is an object of the present invention to reduce compressor noise caused by the discharge reed valve contacting the machined profiled supporting stops.

It is a further object of our invention to provide a gasket which in part conforms to the machine compressor head at assembly.

It is still a further objection of the invention to provide that the discharge valve deflection follows the gasket/machined head profile.

It is still a further object of the invention to provide reduction in the noise transmission paths for the gasket by preventing a short and direct path for noise into the inner clamping area of the gasket.

It is yet a further object of the invention to reduce the fatigue failure of the discharge reeds.

The above and other objects of the invention are accomplished by an air conditioning compressor which comprises a compressor housing including front and rear housing heads and a pair of cylinder blocks disposed in the housing each defining axially disposed cylinders. The compressor also includes a double-acting piston in each cylinder opening, a swashplate and drive shaft assembly having a swashplate driveably engageable with each piston and a driveshaft mounted in each cylinder block coaxially therewith. The compressor further includes a valve assembly located between each housing head and each respective cylinder block. Each valve assembly includes an intake valve means disposed adjacent to the respective cylinder block, the intake valve means including valve reeds that control flow from the low pressure passages to the cylinders, a valve plate disposed adjacent to the intake valve means, a discharge valve means disposed adjacent the valve plate, and a noise reducing gasket means disposed between the discharge valve means and the housing head. The noise reducing gasket means includes a first region disposed at a radially inward part of the gasket means for sealingly limiting gas transfer radially inwardly from the high pressure region, a second region radially outwardly spaced from the first region for sealingly limiting gas transfer from the high pressure region to the low pressure region, and a plurality of resilient members mounted in a cantilever fashion to the second region and having a free end spaced from the first region.

We have found that by providing a gasket with resilient members which are interposed between the machined head stops and the discharge reed that noise reduction as well as fatigue of the discharge reed valve elements can be substantially reduced. Further, by disconnecting the impact areas of the discharge reed valve on these gasket locations it is possible to reduce the noise transmission paths from the inner clamping area to the resilient members. This further enhances the noise reduction capability of the present invention.

Our improved construction substantially reduces the noise and improves the reliability of the compressor while taking advantage of cost effective manufacturing techniques and allow the axial length of the finished compressor assembly to be maintained.

BRIEF DESCRIPTION OF THE DRAWINGS

FIG. 7 is a plan view of the front of the valve plate used in the assembly.

FIG. 8 is an edge or end view of the plate of FIG. 7.

FIG. 9 is a plan view of the inlet valve reed positioned at each axial end of the cylinder blocks.

FIG. 10 is a plan view of the outlet or discharge reed valve located at each axial end of the cylinder blocks.

FIG. 14 is a sectional view taken along the plane of section line 14—14 of FIG. 13.

FIG. 15 is a plan view of the gasket for the discharge reed valve and valve plate at each end of the cylinder blocks.

FIG. 16 is an edge or end view of the gasket as seen from the plane of the section line 16—16 of FIG. 15.

FIG. 17 is an enlarged view of the machine stop and valve assembly including the gasket, this view is enlarged as indicated by the circle shown in FIG. 1.

DETAILED DESCRIPTION OF THE PREFERRED EMBODIMENTS

Figure 1:
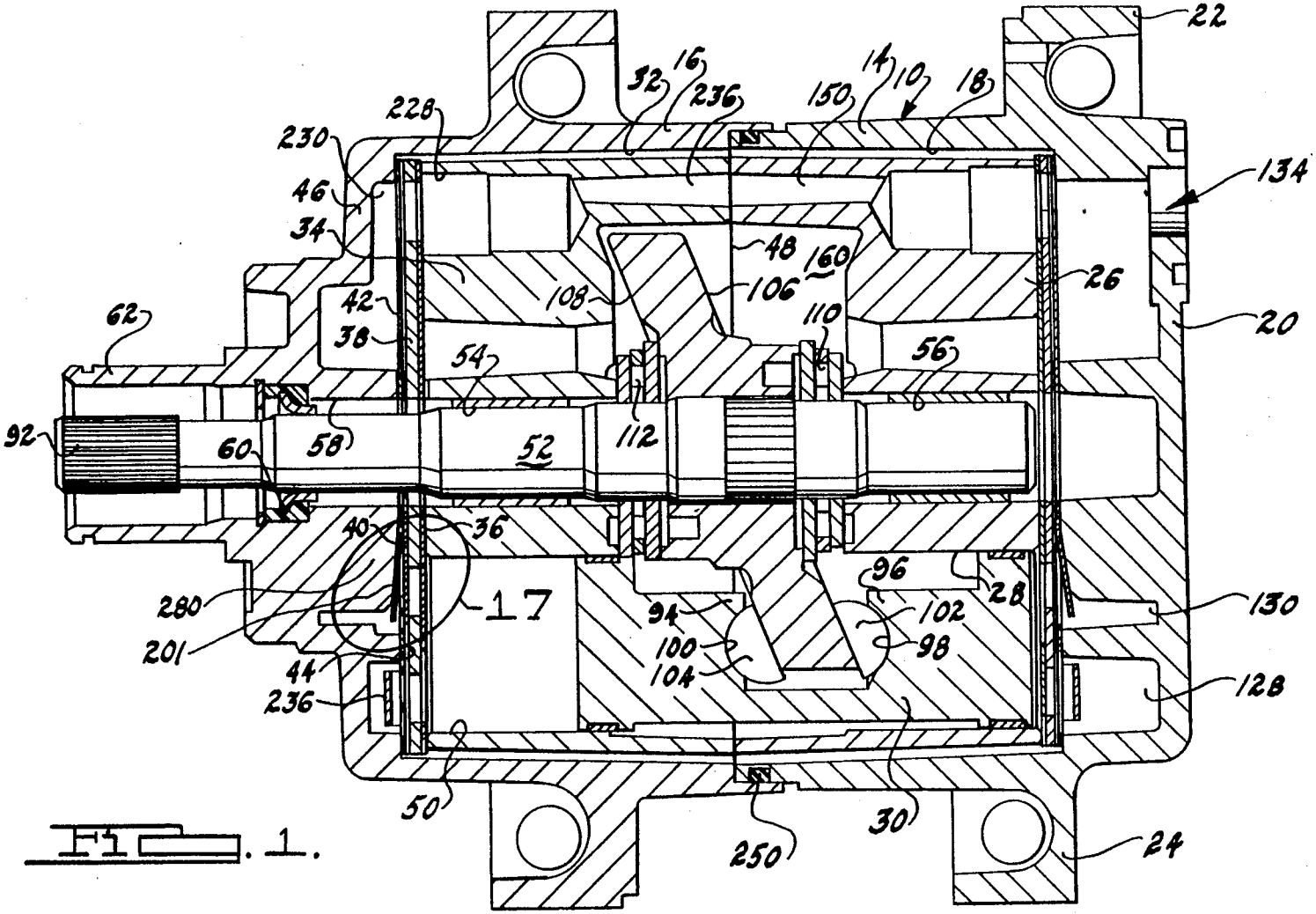
FIG. 1 is a partial radial cross-sectional view of the valve assembly of our invention.

FIG. 1 discloses an air conditioning compressor having a cast housing generally indicated by reference numeral 10. The housing 10 includes a generally cylindrical rear housing part 14 and a generally cylindrical front housing part 16, each of which is formed of die cast aluminum alloy. Rear housing part 14 has a cylindrical interior 18 and an integral end wall 20 that forms a part of the die casting. Mounting bosses 22 and 24 are formed as a part of the die casting, and mounting bolts are received in bolt openings formed in the bosses 22 and 24.

A die cast aluminum cylinder body 26, in which is formed a plurality of cylinder openings, is itself of cylindrical shape and is fitted within the interior opening 18 with a very small clearance between the inner diameter of the cylindrical opening 18 of the housing part 14 and the outer diameter of the cylinder body 26.

One of the cylinder openings in the cylinder body 26 is shown at 28. A compressor piston 30 is slidably received in the cylinder opening 28 and other respective pistons are slidably received in the other respective cylinder openings. The front compressor head comprises the companion housing part 16. Like the housing part 14, housing part 16 has a circular central opening as seen at 32. A cylinder body 34, which itself is of cylindrical shape, is received in the cylindrical opening 32 with a minimum clearance between its outer diameter and the inside diameter of the cylindrical opening 32. An inlet valve plate in the form of a circular spring steel disc is identified by reference numeral 36. That disc will be described with reference to FIG. 9. Adjacent the disc 36 is a front valve plate 38, which has formed in it valve openings that are registered with reed valve elements of the inlet valve disc 36. This front valve plate 38 will be described with reference to FIG. 7.

A front discharge valve plate 40, which will be described with reference to FIG. 10, is located directly adjacent to valve plate 38. It is formed with reed valve elements that register with valve openings formed in the valve Plate 38. A front gasket plate 42 is disposed between the front discharge valve plate 40 and the end surface 44 of the opening 32 formed in the housing part 16. Surface 44 is a machined surface on the inner face of the end wall 46 defining a head of the housing part 16.

As seen in FIG. 1, the cylinder block 26 is assembled in abutting relationship with respect to the cylinder block 34, the abutting surfaces being identified by common reference numeral 48. As seen in FIG. 1, cylinder opening 28 is aligned with cylinder opening 50 in cylinder block 34, thus, forming a common cylinder for the reciprocating piston 30.

A swashplate shaft 52 is journaled by bushing 54 in cylinder block 34 and by bushing 56 in cylinder block 26. Shaft 52 extends through end plate opening 58 in end plate 46. A fluid and gas pressure seal 60 seals the interior of the housing as the shaft 52 rotates in the shaft opening 58.

A stationary sleeve shaft extension 62 is formed on the end plate 46 and provides support for an electromagnetic clutch, pulley and coil, not shown.

Figure 6:
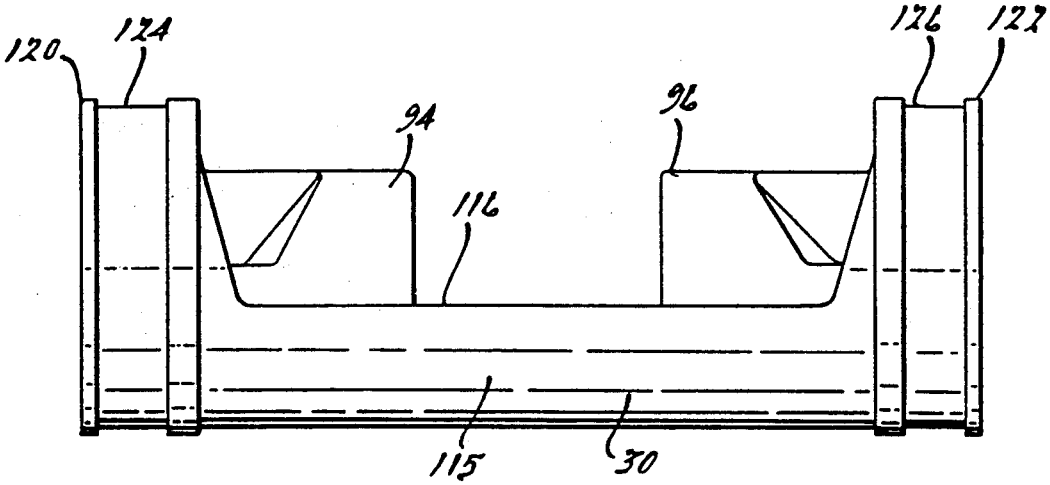
FIG. 6 is a side view of a piston adapted to be received in a cylinder of the cylinder block of FIGS. 2 and 3.

As seen in FIG. 1 and in FIG. 6, the piston 30 comprises two axially spaced bosses 94 and 96, which are machined to provide semi-spherical pocket recesses 100 and 98 (FIG. 1) for swashplate shoes 104 and 102, respectively. The shoes are provided with flat bearing surfaces that slidably engage surfaces 106 and 108, respectively, on the swashplate and shaft assembly shown in FIG. 1 and in FIG. 4.

Figure 4:
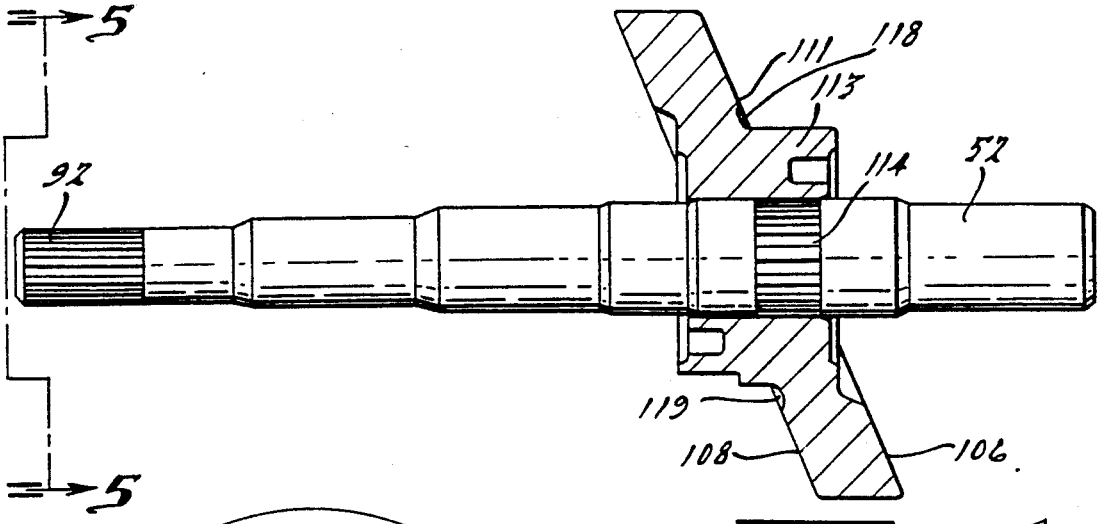
FIG. 4 is a side elevational view of a swashplate and shaft assembly which forms a part of the assembly of FIG. 1.
Figure 5:
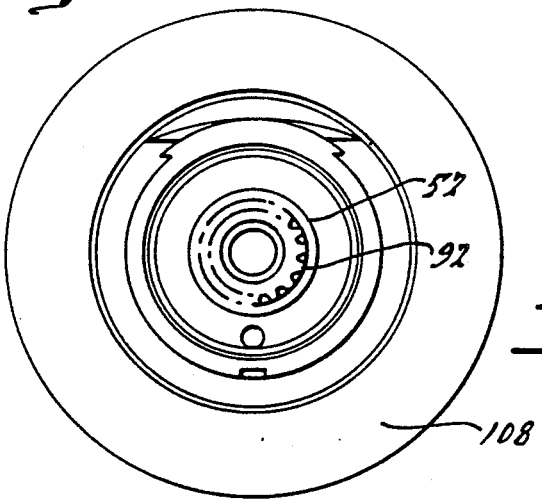
FIG. 5 is an end view of the structure of FIG. 4 as seen from the plane of section line 5—5 of FIG. 4.

The swashplate is disposed as seen best in FIG. 4, at an angle relative to the axis of the shaft. The swashplate itself, which is designated by reference character 111, includes a hub 113 that is press fitted on the shaft 52 and that is locked in place by serrations 114 formed on the shaft 52 prior to the assembly of the swashplate 111 on the shaft by the press fitting operation. As the shaft 52, shown in FIG. 1, rotates, the swashplate 106, due to the sliding engagement with the shoes 102 and 104, causes the piston 30 to reciprocate in the cylinder defined by the cylindrical openings 28 and 50 in the cylinder blocks 26 and 34, respectively. The thrust forces on the swashplate are accommodated by the radial needle bearing assemblies 110 and 112, which respectively engage the cylinder blocks 26 and 34 whereby the thrust on the swashplate hub is absorbed by the cylinder blocks.

The shoes 102 and 104 carry a lubricating oil film thus establishing a nonabrasive sliding bearing relationship with respect to the surfaces 106 and 108 as the pistons are reciprocated.

As best seen in FIG. 6, the piston 30 is formed of a unitary die casting or is forged. It includes a bridged portion 115 of reduced step with respect to the portion of the ends of the piston. The bridge portion is formed during the die casting operation or forging with an upper surface 116 that is situated below the centerline of the piston. This permits sufficient clearance for the outer margin of the swashplate 111, thereby preventing interference during operation of the compressor. These manufacturing operations reduce complex machining operations that heretofore were needed to form reciprocating pistons in some swashplate compressors.

As seen in FIG. 6, the piston is a double acting piston and it is provided with piston ends 120 and 122 of equal diameter. Each end 120 and 122 has a piston seal groove 124 and 126 which receives a piston seal ring.

Figure 11:
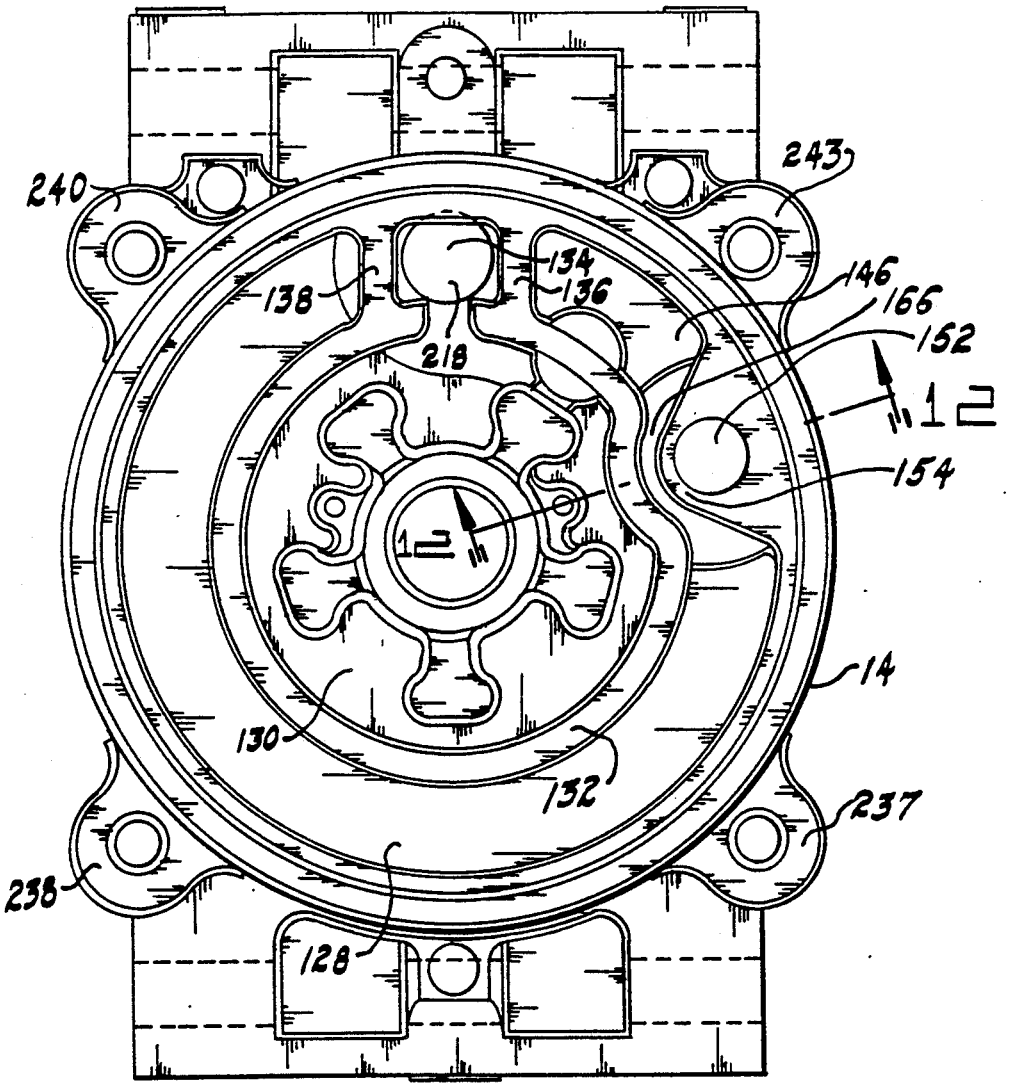
FIG. 11 is an end view of the rear casting head or housing for the assembly. It shows the interior porting and passage arrangement at the end wall of the opening in the casting head.
Figure 12:
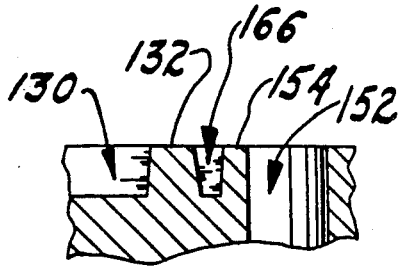
FIG. 12 is a sectional view taken along the plane of section line 12—12 of FIG. 11.

The rear housing end wall 20 of the housing part 14 has inlet and outlet pressure cavities that are formed in it during the die casting operation. The low pressure inlet cavity shown at 128 encircles the shaft 52 as seen in FIG. 11. Low pressure cavity 128 is fluidly connected to low pressure cavity 146 via passage 166. Thus, the low pressure cavity is constituted by area 128, 166 and 146. This low pressure cavity is separated from the high pressure passage 130 by a cylindrical baffle 132. The outlet port 134, which is a high pressure discharge port, is shown in FIGS. 1 and 11. The upper extremity of the cylindrical baffle wall 132, as seen in FIG. 11, registers with and forms a continuation of the separator walls 136 and 138 which isolate the outlet passage from the low pressure cavity.

Figure 2:
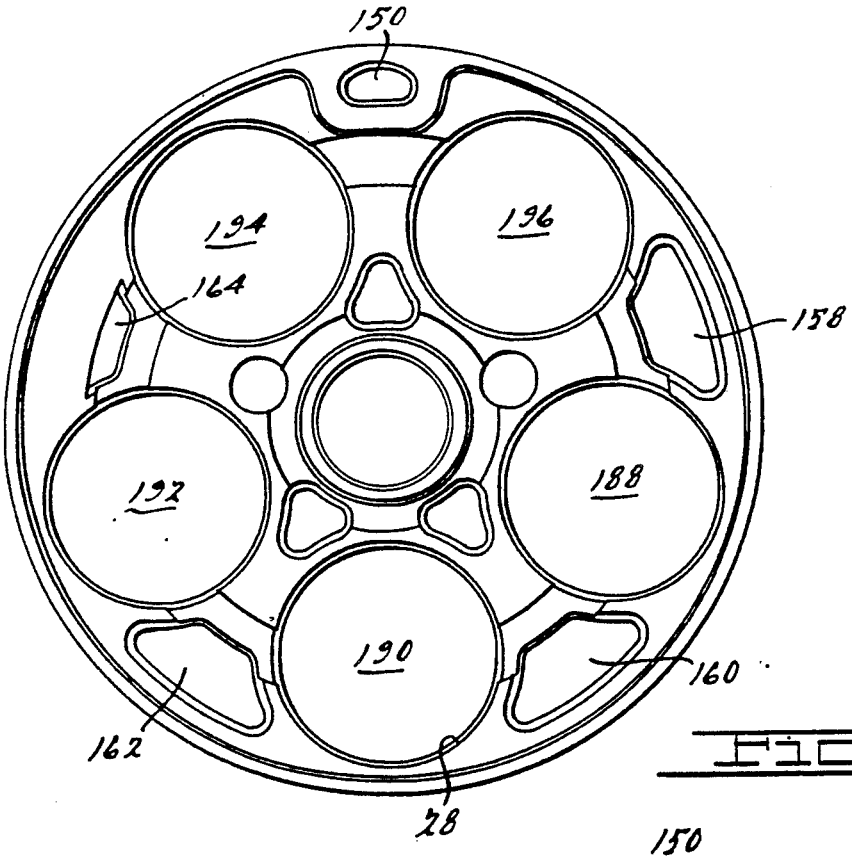
FIG. 2 is an end view of one of the two cylinder blocks that form a part of the assembly of FIG. 1.

In FIG. 11 the inlet opening for the refrigerant is shown at 152. It should be noted that in FIG. 11 the communication between opening 152 and the arcuate region of the low pressure cavity 128, 166 and 146 is interrupted by bridge 154. The plane of the inner surface of the bridge 154 is common to the plane of the inner surface of the baffle wall 132. Low pressure refrigerant passes from the inlet port 152 through the rear gasket 42 into opening 158 of the rear valve plate 38 shown in FIG. 7. The gas continues by passing directly through openings 156 in the reed valve plate 36 as seen in FIG. 9. The refrigerant gas is then passed through openings 158 that are cast in the cylinder body 26 as seen in FIG. 2.

The gases then accumulate in the region 160. From there the refrigerant gases pass into each of the other cast low pressure passages 162 and 164 as seen in FIG. 2 via appropriate openings in the cast which are cast in the cylinder bodies. The right hand end of each of these cast passages seen in FIG. 2 communicates with the low pressure Passage cavity 128, 166, 146 that is cast in the end wall 20 of the housing part 14, as previously described.

The reed valve disc of FIG. 9 includes a flexible cantilever part 170 which registers with the opening 168 and permits one-way flow through the opening 168 when the piston for the associated cylinder adjacent to it undertakes its intake stroke. There are multiple cantilever valve elements 172, 174, 176, and 178, as well as 170. These valve elements or reeds register with valve plate openings 180, 182, 184, and 186, as well as with opening 168. The cylinder block 26, as seen from FIG. 2, has five cylinder openings which accommodate five compressor pistons and each cylinder is served by a separate one of the reed valves shown in FIG. 9. As each piston 130 is stroked in the left hand direction as seen in FIG. 1, refrigerant is drawn through the valve plate opening and past its associated valve reed. Refrigerant is then drawn from the opening 128 in the case of cylinders 188, 190, 192, and 194 which are identified in FIG. 2. In the case of cylinder 196, shown in FIG. 2, refrigerant is drawn directly from the opening 146.

The discharge reed assembly of FIG. 10 includes a plurality of reed valve elements separately identified by reference characters 198, 200, 202, 204, and 206. Each of these valve elements registers with high pressure discharge openings 208, 210, 212, 214 and 216, as seen in FIG. 7. Each of these openings has a discharge port for the high pressure refrigerant as the pistons of the respective cylinders are stroked in the right hand direction, as seen in FIG. 1. The discharge reed shown in FIG. 10 permit one-way flow of high pressure gases into the discharge flow path 130 previously described with reference to FIG. 11. A baffle wall 132 is separated at 218 to permit communication between passage 130 and the discharge passage 134.

Figure 13:
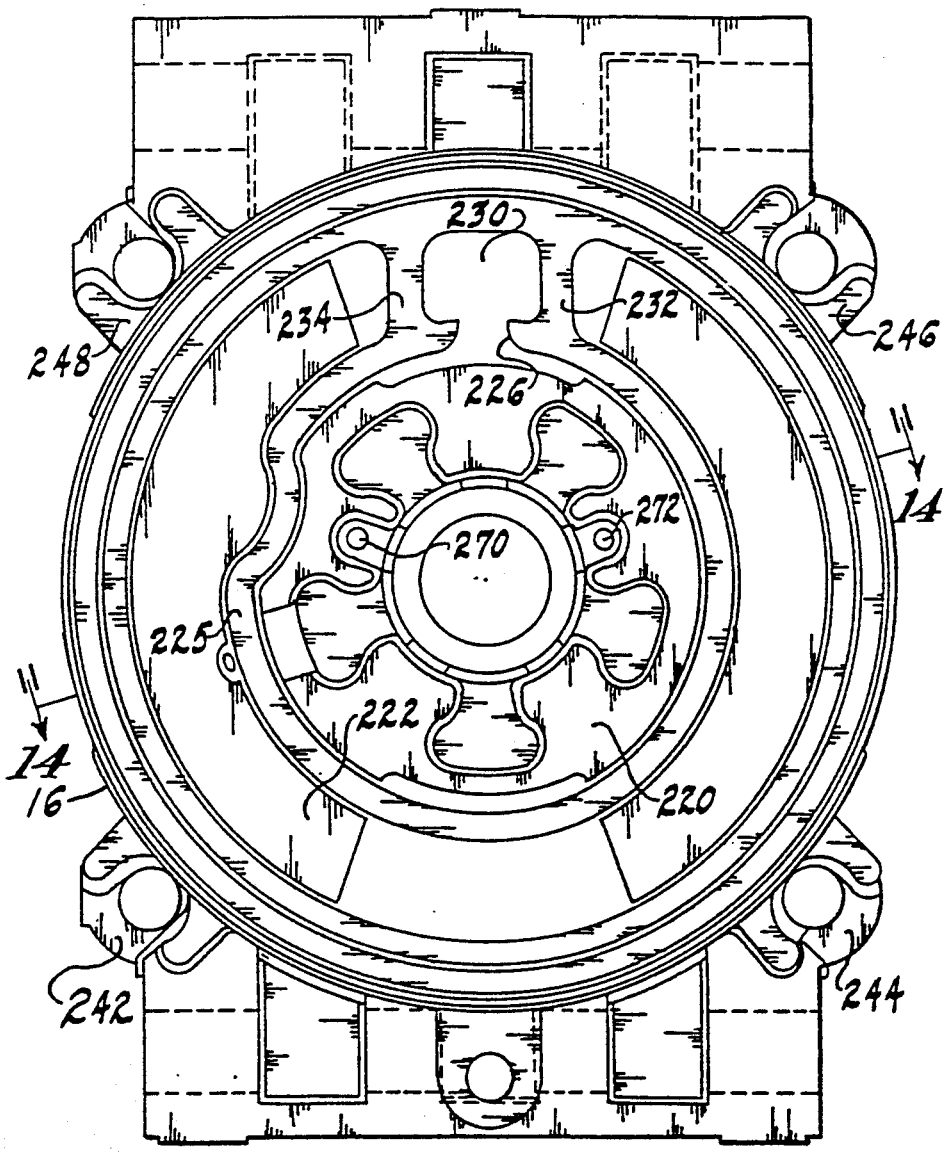
FIG. 13 is an end view of the front casting head of the housing showing the interior of the end wall of a front head together with the porting and passage structure.

The cylinder block 34 is identical and interchangeable with the cylinder block 26. The valve plate, the inlet reeds and the discharge reeds described with reference to the rear housing part 14, are identical to those that function with respect to the front housing part 16. Like the rear housing part 14 shown in FIG. 11, the front housing part 16 shown in FIG. 13 is provided with cast high pressure and low pressure passages. The high pressure passage shown at 220 corresponds to high pressure passage 130 of the rear housing part of FIG. 11. The low pressure passage 222 of FIG. 13 corresponds to low pressure passage 128 of the rear housing part 14.

A baffle wall 225, which corresponds to the baffle wall 132 of the rear housing part 14, separates passages 220 and 222. The wall 225 is discontinuous as shown at 226 to provide communication between passages 220 shown in FIG. 13 and the outlet opening 228 as seen in FIG. 1. The region 230, seen in FIG. 1 and in FIG. 13, which is the high pressure region, is separated from the low pressure inlet passage 222 by bridge portion 232 and 234 of the baffle wall 225.

Fluid that is discharged by the pumping pistons passes from discharge passage 220 (FIG. 13) into the region 230 (FIGS. 1 and 13), whereupon it passes through internal crossover passage 236 seen only in FIG. 1. This passage corresponds to passage 150 that was described with reference to the rear cylinder block of FIG. 2. Passage 150 and passage 236 register at their juncture to form a continuous passage that communicates with the discharge opening 134 seen in FIG. 1. This internal crossover passage eliminates the need for providing a separate crossover tube as in some prior art arrangements, and it may be formed during the die casting operation with minimal finish machining operations being required.

FIG. 15 shows a noise reducing gasket or seal plate 42 that is interposed between the valve plate 38 and the inner machined surface of the front and rear housing parts. The gasket 42 includes an opening 221 which communicates with a high pressure opening 188 in the valve plate 38 of FIG. 7. It also includes openings 223, 224, 226 and 228 which register with cast end openings in the front cylinder block, which, in turn, correspond to the cast end openings previously described with reference to the cylinder block 26 shown in FIG. 2. These respectively are shown in FIG. 2 at 150, 158, 160, 162 and 164.

FIG. 15 shows at reference numeral 231 an elongated embossment which encircles the axis of the shaft 52 and which envelopes the passage 220. The elongated embossment forms a continuous ridge adjacent to the valve plate which registers with the machined inner surface of the baffle wall 225, as shown in FIG. 13. It also registers with the machine surface of the bridge portions 232 and 234 of the baffle wall 225. Thus, the elongated embossment forms an effective seal that isolates the high pressure passage 220, from the lower pressure passage 222. The gasket of FIG. 15 also includes an inner elongated embossment ring 233 which prevents passage of high pressure refrigerant from the high pressure discharge port for the cylinders from the region of the bearing 54 and the shaft opening 58. It also secures the reed valve elements of the discharge valve, thus, preventing over stressing of those valve elements.

The casting housing head 16 shown in FIG. 1 has stops 280 with machined inner gasket support stop surfaces which are sloping as indicated by reference numeral 201. These are shown in FIGS. 1, 14 and 17. Adjacent the gasket support stop surfaces 201 of the cast housing head are situated portions of the noise reducing gasket 42. The gasket 42 includes resilient members 282 which members are bent such that they contact and conform to the gasket support stop surface 201 of the stop 280. The resilient members 282 are connected to the gasket by members 284 and 286 as illustrated in FIG. 15 such that the resilient members are mounted in a cantilever fashion. Interposing the resilient members between the discharge feed elements such as 204 and the surfaces 201 effects enhanced noise reduction. The resilient members 282 are not connected to the central circular region but instead are separated therefrom by the space indicated by reference numeral 290. The space 290 may be formed by a stamping or shearing operation. Not connecting the resilient members 282 to the central area 233 of the gasket prevents further noise transmission from being carried through the gasket and, therefore, helps prevent diminish the noise and vibration when the reed valve contacts the resilient member 282.

Thus, when the discharge reed valve element such as 204 is opened by the pressure of compressed refrigerant gas, it can open in a manner such that it is guided by the gasket 42 in its inner region and then when it is fully extended it will contact the resilient members 282 of the gasket.

A similar gasket or seal plate is used to seal the high pressure and low pressure passages in the end wall 20 of the rear housing part 14.

The valve plate for the front cylinder block is identical to the valve plate for the rear cylinder block. Similarly, the inlet valve reeds and the discharge valve reeds for the front and rear cylinder blocks are identical, one with respect to the other. This interchangeability, as well as the interchangeability of the cylinder blocks themselves, maintains the simplicity of both the design and the manufacture and assembly of the components, thus making it possible to have reduced manufacturing costs and improved reliability during operation following assembly.

Radial arms, one of which is shown at 234 in FIG. 15, support the hub of the gasket on which the embossment 233 is formed.

Near the radially outer margin of the gasket of FIG. 15 are straps 236 which provide rigidity to the disc and which are displaced out of the plane of the gasket thereby permitting free flow of refrigerant gas through the valve plate openings and past the inlet valve reeds. The relative position of the straps 236 with respect to the plane of the gasket can be seen by referring to FIG. 16 where the gasket is shown in cross section.

As seen in FIG. 11 the rear housing part 14 has four external bosses 237, 238, 240 and 243. Similarly, the front housing part 16 has bosses 242, 244, 246 and 248, which register with the bosses 237, 238, 240 and 243 of the front housing part 16. Each of these bosses has a bolt opening to permit entry of the clamping bolt. The bolt openings in the rear housing part 14 are threaded to grip the threads on the respective bolts. When the bolts are tightened following assembly of the components, the cylinder blocks are brought into registry, one with respect to the other, and a predetermined load is applied to the gasket. Effective seals are thus established. The left hand margin of the housing part 14 is received within the right hand margin of the housing part 16, as seen in FIG. 1 and an "O" ring seal 250, which is received in an "O" ring groove in the housing part 14, establishes a fluid or gas pressure tight seal between the mating parts.

In addition to the interchangeability of parts—for example, the inlet valve disc, the discharge valve disc and the valve plate—, preassembly of the valve plate with the gasket and the two reed valve discs can be achieved by locator pins which are received in pin openings formed in valve plate 38 illustrated in FIG. 7. These pins are received with a force fit in pin openings 254 and 256 as seen in FIG. 7. Corresponding openings 258 and 260 are formed in the discharge valve of FIG. 10, and these register with the locator pins. Similarly, locator pin openings 258 and 260 are formed in the gasket as formed in FIG. 15, and these also register with the locator pins.

Figure 3:
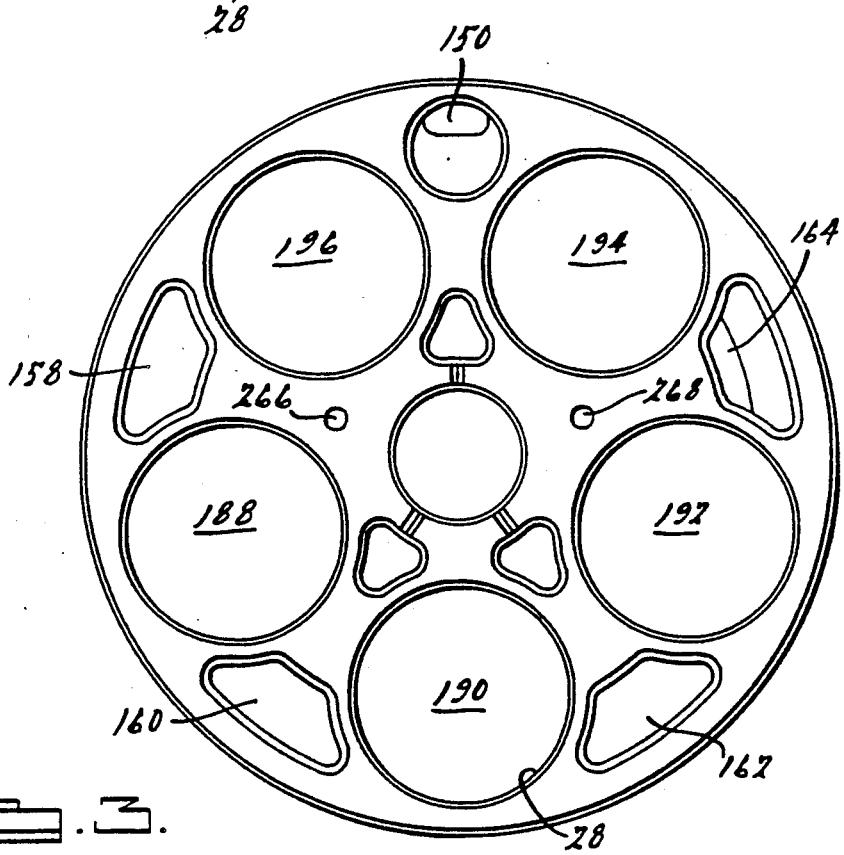
FIG. 3 is an end view showing the opposite end of the cylinder block of FIG. 2.

On the opposite side of the valve plate, pin openings 262 and 264, as seen in FIG. 9, register with the valve pins. Thus the valve plate, the inlet valve disc, the discharge valve disc, and the gasket can be preassembled to simplify the manufacturing operation. After this preassembly procedure the subassembly is inserted into the registering pin locator openings 266 and 268, shown in FIG. 3 for the rear housing part. Corresponding pin openings 270 and 272 for the front housing part can be seen in FIG. 13. These locator pins establish proper angular registry of the assembled parts, one with respect to the other. No fasteners are required and thus the manufacturing cost and assembly cost are low and improved reliability by a simplified assembly is achieved.

The bearings 54 and 56 for the shaft 52 are steel backed sleeve bearings which can be assembled with no further machining being required after installation. These are located, as seen in FIG. 1, adjacent radial needle bearings 112 and 110 respectively. The cage for the radial rollers of the bearings 112 and 110 rotate in the usual fashion between two thrust washer rings. This establishes a centrifugal pumping action which draws lubricant and refrigerant from the inboard ends of the sleeve bearings. A pressure differential exists between the swashplate chamber and the inlet annulus that is cast in each of the end plates for the housing parts. The existence of this pressure differential creates a pressure differential across the bearings themselves and this is aided by the centrifugal action of the rotating cages of the radial needle bearings which act as thrust bearings. Thus the cages of the radial needle bearings, which act as thrust bearings, and the journal bearings are lubricated thereby improving the reliability of the compressor.

By the newly designed compressor gasket and head assembly, the noise produced by the compressor is substantially reduced. The gasket and gasket support surfaces formed in the head form an effective noise damping combination. Further, the resilient members of the gasket help prevent damage to the discharge reed elements when they open.

The gasket support surfaces on the head perform the function of preventing the resilient members of the gasket from being fractured by the discharge reed element contacting them when they open. Additionally, since the resilient members of the gasket are not connected to the hub of the gasket, noise transmission paths and vibration paths are substantially decreased.

In view of the disclosure, many modifications of this invention will be apparent to those skilled in the art. It is intended that all such modifications which fall within the true scope of this invention be included within the terms of the appended claims. For example, the housing does not necessarily need to be made out of only two outer parts, it is contemplated that there may be more than two parts.

What is claimed is:

1. An air conditioning compressor comprising:

a compressor housing including front and rear housing heads, said front and rear housing heads each, individually including a plurality of stop surfaces;

a pair of cylinder blocks disposed in said housing each defining a plurality of axially disposed cylinders, said cylinder blocks abutting one another in axially aligned, juxtaposed relationship whereby the cylinders of one block form continuations of the cylinders for the other block, thus defining common cylinder openings, each cylinder block having formed therein high pressure and low pressure flow passages that communicate with each cylinder of the adjacent cylinder block;

a double-acting piston in each cylinder opening;

a swashplate and drive shaft assembly having a swashplate driveably engageable with each piston and a drive shaft mounted in each cylinder block coaxially therewith;

a valve assembly located between each said housing head and each respective cylinder block, each said valve assembly including:

an intake valve means disposed adjacent to said respective cylinder block, said intake valve means including valve reeds that control flow from said low pressure passages to said cylinders;

a valve plate disposed adjacent to said intake valve means, said valve plate having delivery and discharge ports located therein;

a discharge valve means disposed adjacent said valve plate, said discharge valve means including discharge valve reeds for controlling flow of gas from said cylinders to said high pressure passages; and a noise reducing gasket means disposed between said discharge valve means and said housing head, said noise reducing gasket means including a first region disposed at a radially inward part of said gasket means for sealingly limiting gas transfer radially inwardly from said high pressure region a second region radially outwardly spaced from said first region for sealingly limiting gas transfer from said high pressure region to said low pressure region, and a plurality of resilient members interposed between said discharge valve reeds and said stop surfaces, said resilient members mounted in a cantilever fashion to said second region and having a free end spaced-apart from said first region, said resilient members adapted to reduce noise generated during the operation of said compressor by preventing direct contact of said discharge valve reeds against said stop surfaces during the discharge of a gas from said cylinders through said valve plate discharge ports.

2. An air conditioning compressor as defined in claim 1, wherein said stop surfaces include a flat portion and a portion which is disposed at an angle to said flat portion.

3. An air conditioning compressor as defined in claim 2, wherein said resilient members are disposed such that a portion thereof contacts and conforms to said stop surfaces.

4. An air conditioning compressor comprising:

a compressor housing including front and rear housing heads, said front and rear housing heads each, individually including a plurality of stop surfaces, said stop surfaces including a flat portion and a portion which is disposed at an angle to said flat portion;

a pair of cylinder blocks disposed in said housing each defining a plurality of axially disposed cylinders, said cylinder blocks abutting one another in axially aligned, juxtaposed relationship whereby the cylinders of one block form continuations of the cylinders for the other block, thus defining common cylinder openings, each cylinder block having formed therein high pressure and low pressure flow passages that communicate with each cylinder of the adjacent cylinder block;

a double-acting piston in each cylinder opening;

a swashplate and drive shaft assembly having a swashplate driveably engageable with each piston and a drive shaft mounted in each cylinder block coaxially therewith;

a valve assembly located between each said housing head and each respective cylinder block, each said valve assembly including:

an intake valve means disposed adjacent to said respective cylinder block, said intake valve means including valve reeds that control flow from said low pressure passages to said cylinders;

a valve plate disposed adjacent to said intake valve means, said valve plate having delivery and discharge ports located therein;

a discharge valve means disposed adjacent said valve plate, said discharge valve means including discharge valve reeds for controlling flow of gas from said cylinders to said high pressure passages; and a noise reducing gasket means disposed between said discharge valve means and said housing head, said noise reducing gasket means including a first region disposed at a radially inward part of said gasket means for sealingly limiting gas transfer radially inwardly from said high pressure region a second region radially outwardly spaced from said first region for sealingly limiting gas transfer from said high pressure region to said low pressure region, and a plurality of resilient members interposed between said discharge valve reeds and said stop surfaces, said resilient members mounted in a cantilever fashion to said second region and having a free end spaced-apart from said first region, said resilient members being disposed such that a portion thereof contacts and conforms to said stop surfaces, said resilient members adapted to reduce noise generated during the operation of said compressor by preventing direct contact of said discharge valve reeds against said stop surfaces during the discharge of a gas from said cylinders through said valve plate discharge ports.

* * * * *